United States Patent [19]

Wilson

[11] 4,148,466

[45] Apr. 10, 1979

[54] TENSION BAR FOR FENCE CONSTRUCTION

[76] Inventor: Rollin V. Wilson, 4206 Longleaf, Memphis, Tenn. 38117

[21] Appl. No.: 876,069

[22] Filed: Feb. 8, 1978

[51] Int. Cl.[2] ..... E04H 17/10

[52] U.S. Cl. ..... 256/47

[58] Field of Search ..... 256/37, 33, 34, 47; 254/83

[56] References Cited

U.S. PATENT DOCUMENTS

| | | | |
|---|---|---|---|
| 1,631,942 | 6/1922 | Thomson | 256/47 |
| 2,331,390 | 10/1943 | Gustafson | 256/47 |
| 2,976,019 | 3/1961 | Heyman | 256/47 |
| 3,544,071 | 12/1970 | Case | 256/47 |
| 3,993,288 | 11/1976 | Pfarr, Jr. | 256/47 |

*Primary Examiner*—Werner H. Schroeder

*Assistant Examiner*—Doris L. Troutman

[57] ABSTRACT

An elongated tension bar intended to be used with the well-known chain link type fence wherein pipelike frame structure and tension bands are provided for cooperating with the instant tension bar to maintain tension on the fence fabric. The transverse cross section of the tension bar is such that regardless of how carelessly the bar is first placed in the end loops of the fabric, the strain or tension subsequently applied thereto causes it to automatically slide into the interior curved or contoured shape of the wire fabric so that it seats snugly into an optimum orientation thus enabling it to perform its task perfectly, i.e., since the bar is immobilized in its optimum orientation, it cannot twist or shift to an undesirable position which normally results in curved or broken bars and loose fabric.

3 Claims, 2 Drawing Figures

TENSION BAR FOR FENCE CONSTRUCTION

BACKGROUND OF THE INVENTION

1. Field of the Invention

This invention relates to the field of fence construction and is particularly directed toward specific construction of tension bars used in chain link type fences.

2. Description of the Prior Art

Heretofore, tension bar construction was simply a straight bar of steel which was rectangular shaped in transverse cross section. One particular problem involving the prior steel tension bar construction is that it can shift about a vertical axis thus presenting its weaker orientation to the tensional forces being applied to the fabric. Thus, the bar is easily bent or curved along its weaker dimension resulting in loose fabric.

With the shortage of steel in recent years, an attempt to substitute plastic or fiberglass in the construction of these tension bars met with a degree of success but certain problems immediately came to the foreground. One of these problems stems from the fact that the design of the tension band or clamps is not such that the correct position or orientation of the bar can be guaranteed especially in light of numerous persons who serve as installers where quality installation is not always in order. It will be appreciated by those skilled in the art that steel tension bars will sometimes bend, but the nature of this material is that it forgives a lot of poor installation errors. On the other hand, poor installation of a fiberglass bar is not forgiving. Accordingly, the prior fiberglass tension bars frequently were broken since the fiberglass bars are unidirectional and require that these bars be placed in a particular position or orientation where the directional strength is at its maximum.

SUMMARY OF THE INVENTION

The present invention is directed towards overcoming the problems and disadvantages of prior tension bar construction. The concept of the present invention is to provide a tension bar that will first keep its position or orientation, hold the fabric tight, and stay in straight alignment indefinitely thereafter. Also, the intent is to provide a bar that will automatically perform its duty regardless of how carelessly the bar is first placed in the end loops of the fabric.

The elongated tension bar of the present invention is intended to be used with the well-known chain link type fence wherein pipelike frame structure and tension bands are provided for cooperating with the tension bar to maintain tension on the fence fabric. The transverse cross section of the tension bar is such that regardless of how carelessly the bar is first placed in the end loops of the fabric (wire chain link), the strain or tension subsequently applied thereto causes it to automatically slide into the interior curved or contoured shape of the wire fabric so that it seats itself snugly into an optimum orientation thus enabling it to perform its task perfectly, i.e., since the bar is immobilized in its optimum orientation, it cannot twist or shift to an undesirable or weakened position which normally results in curved or broken bars and loose fabric. Therefore, the tension bar of the present invention may be formed from fiberglass or extruded aluminum or steel with the satisfaction that it will accomplish the job it was set out to do.

DESCRIPTION OF THE PREFERRED EMBODIMENT

Figure 1:
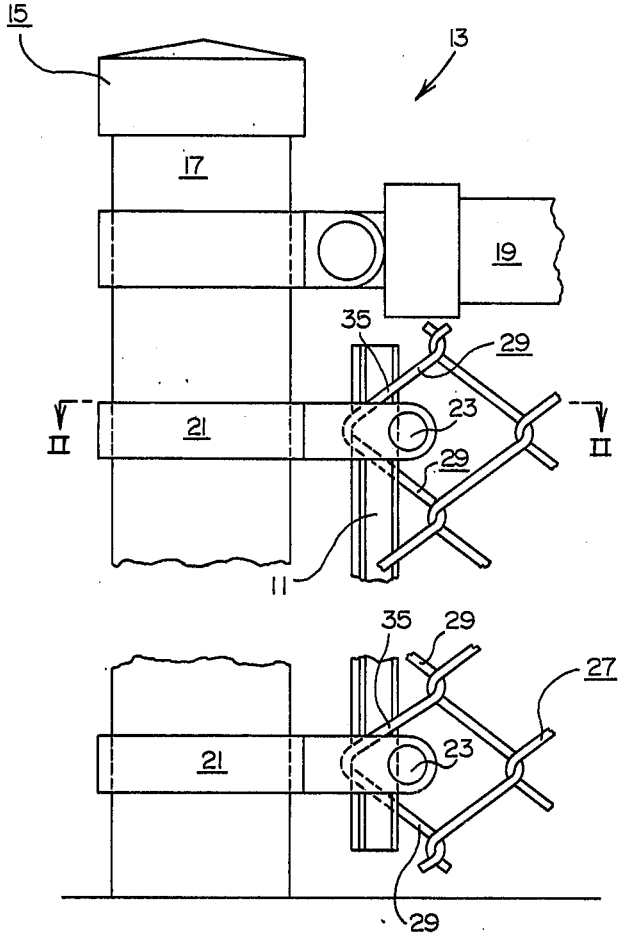
FIG. 1 is a side elevational view of typical fence structure with the tension bar of the present invention shown therewith.
Figure 2:
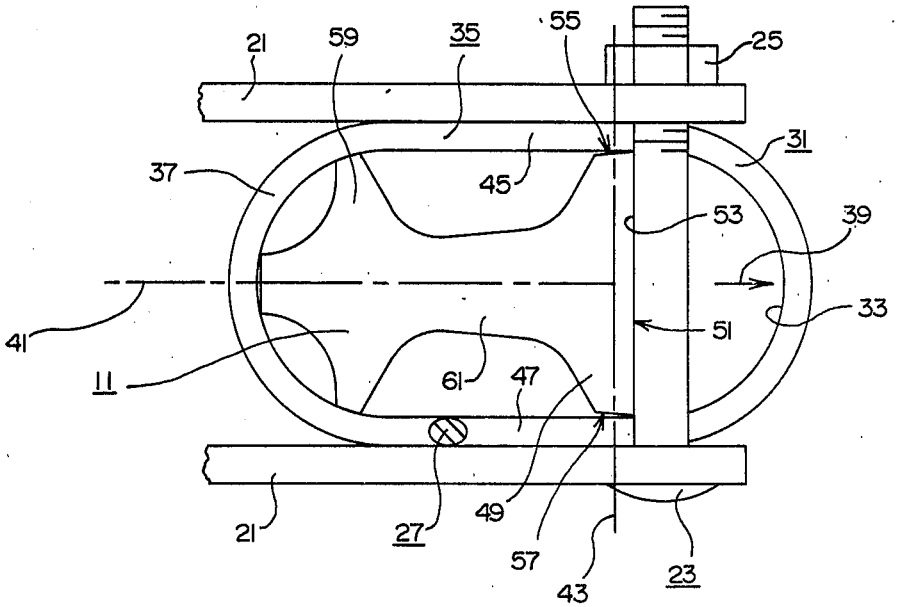
FIG. 2 is an enlarged sectional view taken as on the line II—II of FIG. 1 showing the transverse cross-sectional structure of the tension bar in the manner in which it engages the fence structure.

The tension bar 11 of the present invention is intended for use with typical chain link fence construction, as shown in FIG. 1 of the drawing and character referenced therein by the numeral 13. The fence 13 includes a pipelike frame 15 having the usual vertically disposed terminal post 17 and suitable horizontal members 19 extending therebetween. The fence 13 also includes a plurality of tension band means 21 each having a bolt 23 and a nut 25 as clearly shown in FIGS. 1 and 2 of the drawing. The fence 13 also includes typical fence fabric 27 (e.g. wire chain link) which normally terminates vertically by a plurality of terminal links, as at 29, which establish numerous aligned open loops 31 which when viewed from above as in FIG. 2 present or define an enclosed passageway 33 wherein the tension bar 11 of the present invention is intended to be inserted. Thus, the pipelike frame 15 and the tension band means 21 cooperate with the tension bar 11 of the present invention to maintain tension on the fence fabric 27.

The tension bar 11 of the present invention is of sufficient length to substantially reach from the horizontal members 19 downwardly to the ground, i.e., typical chain link fence construction is either four foot or six foot high (approximately 1.5 or 1.8 meters). Particular attention is now directed toward FIG. 2 of the drawing wherein it may be seen that the tension bar 11 of the present invention is provided with an oblong preformed shape in transverse cross section with the oblong preformed shape having a close-fitting size with respect to a segment, as at 35, of each of the numerous aligned open loops 31 which are established by the terminal links 29 of the fence fabric 27 for uniform close-fitting sheath-like engagement with each of these aligned open loops 31. Further, it may be seen that the oblong preformed shape substantially conforms to the internal curvature defined by the termini of the terminal links 29 to assure that the tension bar 11 maintains optimum unyielding orientation with respect to the direction of the tension forces acting thereon, i.e., an arrow 39 indicates the direction of the tension forces acting on the tension bar 11.

More specifically, the cross section of the tension bar 11 includes a major axis, as at 41, and a minor axis, as at 43, with the width of tension bar 11 as measured along minor axis 43 being substantially equal in dimension to the distance between parallel spaced apart portions, as at 45, 47, of the open links 31 and the thickness of tension bar 11 as measured along major axis 41 exceeding the distance therebetween by a significant amount for precluding the likelihood of the major axis 41 inadvertently being malaligned. Thus the optimum orientation of the tension bar 11 is unyieldably maintained.

Further, the cross section of the tension bar 11 includes a base member 49 having a broad flat portion, as at 51, conterminously restingly engaging a tangential portion of the bolt 23, i.e., the tangential portion is shown by the numeral 53, for providing a certain degree of assurance that the tension bar 11 unyieldably maintains optimum orientation. In other words, the conterminous engagement of the flat portion 51 with the tangential portion 53 has in itself, an aligning effect of the major axis 41 as clearly shown in FIG. 2 of the drawing.

The base member 49 includes a pair of remotely disposed loop engaging portions, as at 55, 57, having a predetermined distance therebetween, i.e., the distance being dependent upon the construction features of the fence fabric 27 or more specifically the distance between the portions 45, 47, for assuming a contiguous engagement with these portions 45, 47 and for thusly enhancing the assurance that the tension bar 11 unyieldably maintains optimum orientation.

The cross section of the tension bar 11 also includes a head member 59 disposed remotely from the base member 49 for assuming a contiguous engagement with folded portions, as shown for the terminous 37, of the aligned open loops 31 and for thusly applying the tension on the fence fabric, i.e., the tension or pulling force on the tension bar 11 being in the direction of the arrow 39 as clearly shown in FIG. 2 of the drawing.

Additionally, the transverse cross section of the tension bar 11 also includes an elongated intermediate member 61 disposed lengthwise with respect to the major axis 41 with the intermediate member 61 being interposed between the base member 41 and the head member 59 whereby the major axis 41 is provided with a high degree of rigidity, i.e., the tension bar 11 as herein disclosed offers extreme rigidity toward bending when force is applied in the direction of the arrow 39.

It should be understood that the normal installation of the tension band means 21 is to randomly place them along the length of the terminal post 17, i.e., as opposed to having one tension band 21 for each terminal link 29. Therefore, in actuality the tension bar 11 maintains the tension on the terminal links 29 which are intermediate of the randomly spaced tension bands 21.

From the foregoing it will be seen that I am enabled to secure several advantages in connection with my improved tension bar. In the first place, it is possible to form the tension bar 11 from fiberglass or extruded aluminum or the like with the assurance that it will not bend or break. In the second place, the tension bar 11 of the present invention will automatically assume an optimum position initially at the installation thereof, hold the fabric 27 tight, and remain in straight alignment unyieldingly during the lifetime thereof. In the third place, the tension bar 11 of the present invention will automatically perform the task it was set out to do regardless of how carelessly the bar 11 is first placed in the open end loops 31. In other words, the tension bar 11 automatically slides into the interior curve of the terminus 37 so that it seats in a proper position and will align itself to perform the intended task in an ideal manner.

Although the invention has been described and illustrated with respect to a preferred embodiment thereof, it is to be understood that it is not to be so limited since changes and modifications may be made therein which are within the full intended scope of the invention.

I claim:

1. An elongated tension bar for use with a fence of the type including a fence fabric having terminal links and having numerous aligned open loops which are established by the terminal links and including certain fastening structure employed in constructing the fence, for being inserted through the open loops during construction of the fence, and for maintaining tension on the fence fabric, said tension bar comprising in transverse cross section a major axis and a minor axis with said minor axis being substantially equal in dimension to the distance between parallel spaced apart portion of the open loops and said major axis exceeding the distance between these parallel spaced apart portions by a significant amount for assuring that said tension bar unyieldably maintains optimum orientation with respect to the direction of the tensional forces acting thereon as a result of tension being applied to the fence fabric, said cross section of said tension bar including a base member for restingly engaging the certain fastening structure employed in constructing the fence, said base member including a pair of remotely disposed loop engaging portions having a predetermined distance therebetween for engagement with respective opposite portions of the aligned open loops of the fence fabric.

2. The tension bar as set forth in claim 1 in which said cross section thereof includes a head member disposed remotely from said base member for engaging respective folded portions of the aligned loops of the fence fabric.

3. The tension bar as set forth in claim 2 in which said cross section thereof includes an elongated intermediate member having the length thereof disposed parallel with said major axis and with said intermediate member being interposed between said base member and said head member.

* * * * *